US008653728B2

(12) United States Patent
Simme

(10) Patent No.: US 8,653,728 B2
(45) Date of Patent: Feb. 18, 2014

(54) PHOTOLUMINESCENT DEVICE

(76) Inventor: John L. Simme, Hampstead, NC (US)

( * ) Notice: Subject to any disclaimer, the term of this patent is extended or adjusted under 35 U.S.C. 154(b) by 0 days.

(21) Appl. No.: 13/615,821

(22) Filed: Sep. 14, 2012

(65) Prior Publication Data

US 2013/0141921 A1 Jun. 6, 2013

Related U.S. Application Data

(60) Provisional application No. 61/630,029, filed on Dec. 5, 2011.

(51) Int. Cl.
*H01J 1/62* (2006.01)

(52) U.S. Cl.
USPC ..... 313/493; 257/434; 362/145

(58) Field of Classification Search
USPC ..... 362/145, 84, 652, 364, 365, 310; 257/434; 313/493
See application file for complete search history.

(56) References Cited

U.S. PATENT DOCUMENTS

| | | | | |
|---|---|---|---|---|
| 5,724,909 | A * | 3/1998 | Pitman et al. | 116/202 |
| 5,904,017 | A * | 5/1999 | Glatz et al. | 52/287.1 |
| 6,665,986 | B1 * | 12/2003 | Kaplan | 52/102 |
| 7,473,003 | B2 * | 1/2009 | Stokes et al. | 362/84 |
| 7,993,722 | B2 | 8/2011 | Sturley | |
| D662,684 | S * | 6/2012 | Edwards | D99/17 |
| 8,192,829 | B2 | 6/2012 | Sturley | |
| 2001/0043042 | A1 * | 11/2001 | Murazaki et al. | 313/483 |
| 2006/0291197 | A1 * | 12/2006 | Patti | 362/153.1 |

* cited by examiner

*Primary Examiner* — Mary Ellen Bowman
(74) *Attorney, Agent, or Firm* — Watov & Kipnes, P.C.; Kenneth Watov

(57) ABSTRACT

A photoluminescent device includes a substantially cylindrical housing having an optically transparent upper surface, the housing defining an interior cavity, a phosphorescent material being disposed within the interior cavity proximate the optically transparent upper surface, whereby the housing of the device has an elongate body portion configured for insertion into a bore or hole in a substrate with the optically transparent upper surface positioned proximate to the surface of the substrate.

18 Claims, 4 Drawing Sheets

PHOTOLUMINESCENT DEVICE

PRIORITY CLAIM

The present application claims the benefit of priority from U.S. Provisional Patent Application Ser. No. 61/630,029, filed Dec. 5, 2011, the entire content of which is incorporated herein by reference.

FIELD OF THE INVENTION

The present invention relates to passive light applications, and more particularly to photoluminescent devices and methods for using the same.

BACKGROUND OF THE INVENTION

Photoluminescent materials exhibit the capacity to absorb electromagnetic radiation and then re-radiate the stored energy in a form such as, for example, visible light. One specialized form of photoluminescence is phosphorescence which is used in many applications such as signage, markings for handrails, stairs, pathways and points of egress, camping and fishing gear, power switches, and the like. A phosphorescent material absorbs photons and re-radiates them in a delayed or slower manner. As a result, absorbed photons may be re-emitted at a lower intensity for extended periods of time typically in the range of several hours after the original absorption. Since these materials do not rely on electrical power sources, they are especially useful during low light or dark conditions, such as during a power failure, or in an emergency.

Accordingly, there is a need in the art to develop a photoluminescent device configured for operatively engaging a substrate in a simple and secure manner to provide passive lighting and visibility under low light or dark conditions. There is a further need for such a photoluminescent device that can be readily implemented for use with a range of existing substrates.

SUMMARY OF THE INVENTION

The present invention relates generally to a photoluminescent device and method for using the same for providing passive lighting and visibility under low light or dark conditions. The device of the present invention operates in the absence of an outside power source, thus precluding the need for wiring and associated installation of electrical components. The device of the present invention is designed with enhanced flexibility and ease of installation in various substrates including, but not limited to, ceramic, concrete, brick, plaster, paver and wood. In particular, the device of the present invention is especially useful for placement in floor or ground surfaces such as driveways, patios, sidewalks, walkways, hallways and the like. The device of the present invention provides passive lighting to nearby areas and enhances the aesthetic appearance and safety of such areas during low light or dark conditions. The device of the present invention is safe and environmentally friendly and relatively simple and cost effective to make and implement.

The device of the present invention generally includes a housing with an optically transmissive upper surface and an interior cavity, a photoluminescent material disposed within the interior cavity proximate the optically transmissive upper surface, and the housing further includes a body portion configured for insertion into a bore or hole in a substrate with the optically transmissive upper surface positioned proximate to the surface of the substrate.

In one aspect of the present invention, there is provided a photoluminescent device, which includes:

a housing having an optically transmissive upper surface, the housing defining an interior cavity;

a photoluminescent material disposed within the interior cavity proximate the optically transmissive upper surface; and the housing including a body portion configured for insertion into a bore or hole in a substrate with the optically transmissive upper surface positioned proximate to the surface of the substrate.

In a further aspect of the present invention, there is provided a photoluminescent device, which includes:

a substantially cylindrical housing having an optically transparent upper surface, the housing defining an interior cavity;

a phosphorescent material disposed within the interior cavity proximate the optically transparent upper surface; and the housing including an elongate body portion configured for insertion into a bore or hole in a substrate with the optically transparent upper surface positioned proximate to the surface of the substrate.

In another aspect of the present invention, there is provided a method for using a photoluminescent device, which includes the steps of:

forming a bore or hole into the surface of a substrate;

obtaining a photoluminescent device comprising:

a housing having an optically transmissive upper surface, the housing defining an interior cavity;

a photoluminescent material disposed within the interior cavity proximate the optically transmissive upper surface; and the housing including a body portion configured for insertion into the bore or hole in the substrate with the optically transmissive upper surface positioned proximate to the surface of the substrate; and inserting the body portion of the photoluminescent device housing into the bore or hole with the optically transmissive upper surface positioned proximate to the surface of the substrate.

BRIEF DESCRIPTION OF THE DRAWINGS

The following drawings are illustrative of embodiments of the invention and are not intended to limit the invention as encompassed by the claims forming part of the invention.

DETAILED DESCRIPTION OF THE INVENTION

Figure 1:
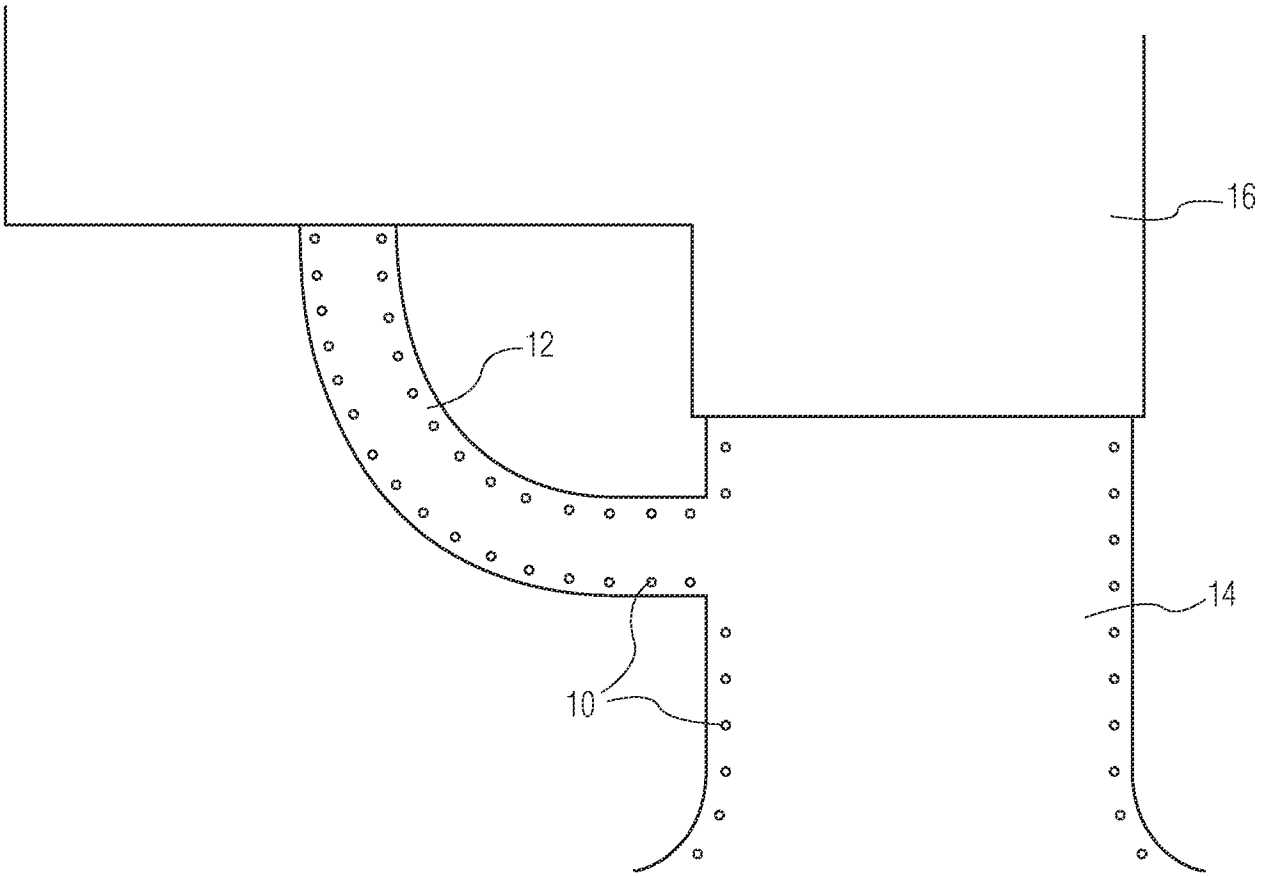
FIG. 1 is a schematic diagram of residential property having a plurality of photoluminescent devices installed on the grounds thereof for one embodiment of the present invention.

The present invention is directed to a photoluminescent device and method for using the same for providing passive lighting and visibility under low light or dark conditions. The device of the present invention operates in the absence of an outside power source, thus precluding the need for wiring and associated installation of electrical components. The device of the present invention is designed with enhanced flexibility and ease of installation in various substrates including, but not limited to, ceramic, concrete, brick, plaster, paver and wood. In particular, the device of the present invention is especially useful for placement in floor or ground surfaces such as driveways, patios, sidewalks, walkways, hallways and the like. The device of the present invention provides passive lighting to nearby areas and enhances the aesthetic appearance and safety of such areas during low light or dark conditions. The device of the present invention is safe and environmentally-friendly and is relatively simple and cost effective to make and implement.

The device of the present invention generally includes a housing with an optically transmissive upper surface and an interior cavity, a photoluminescent material, preferably a phosphorescent material, disposed within the interior cavity proximate the optically transmissive upper surface, and the housing further includes a body portion configured for insertion into a hole in a substrate with the optically transmissive upper surface positioned proximate to the surface of the substrate.

The device of the present invention can be implemented for various applications including, but not limited to, markings for egress, pathways, identifications or signages, demarcations for driveways, stair risers, patios, sidewalks, joints of walls and floor, ramps, decks, doorways, docks, hallways, or handrails, and creative patterns, artwork, and the like. The device of the present invention utilizes photoluminescent substances, preferably phosphorescent materials, retained in optically transmissive vessels to passively illuminate areas under low light or dark conditions. The phosphorescent materials absorb photons from natural or artificial light sources to achieve a charged state, and re-emit the photons as visible light or other form of electromagnetic radiation under low light or dark conditions discharging the stored energy over an extended period of time which can range from a few hours to several hours or more.

The term "photoluminescent materials" is intended to encompass any material possessing the capacity to absorb electromagnetic radiation to achieve a charged state, and re-emitting the stored energy as visible light or other forms of electromagnetic radiation. Such materials can exhibit any form of photoluminescence including, but not limited to, chemiluminescence, fluorescence and phosphorescence. In a preferred embodiment of the present invention, the photoluminescent material is selected from phosphorescent materials.

The term "phosphorescent materials" is intended to encompass a photoluminescent material in which the energy absorbed from the electromagnetic radiation is released slowly, typically, in the form of visible light. Such phosphorescent materials are able to emit the stored energy over prolonged or extended periods of time which can vary from few hours to many hours depending on the selected material.

Examples of phosphorescent materials include, but not limited to, alkaline earth metal aluminates such as strontium aluminate, magnesium aluminate, calcium aluminate and barium aluminate, alkaline earth metal silicates such as barium silicate, zinc silicate and strontium silicate, metal sulfides such as zinc sulfide and calcium sulfide, and combinations thereof. Such materials can further be formulated with dopants such as, for example, copper, aluminum, silver, gold, manganese, gallium, indium, scandium, lead, cerium, terbium, europium, gadolinium, samarium, praseodymium, and other metals, rare-earth elements and halogens. It is noted that the examples of phosphorescent materials are provided for illustrative purposes, and that the present invention encompasses any phosphorescent materials as known to those skilled in the art.

The term "optically transmissive surface" is intended to mean any non-opaque surface having the property of transmitting electromagnetic radiation including light therethrough in both directions and may encompass any degree of transmissibility from transparent to translucent. The optically transmissive surface can be composed of any suitable optically transmissive material including, but not limited to, glasses, crystals, polymers, ceramics, metals, and combinations thereof.

In reference to FIG. 1, there is shown a plurality of photoluminescent devices, each identified generally by reference numeral 10, furnishing passive lighting under low light or dark conditions in accordance with one embodiment of the present invention. The device 10 is adapted for secure mounting to a sturdy substrate such as, for example, ceramic, concrete, brick, plaster, paver or wood, which may be part of a larger structure such as a walkway 12 or a driveway 14 of a house 16 as shown in FIG. 1. The plurality of devices 10 can be installed along the edge portions of the walkway 12 and the driveway 14 to illuminate the path for the user. The devices 10 are configured to provide a level or flat layout with the surface of the walkway 12 or driveway 14 to enhance appearance and unobtrusiveness, and minimize tripping hazards.

Figure 2:
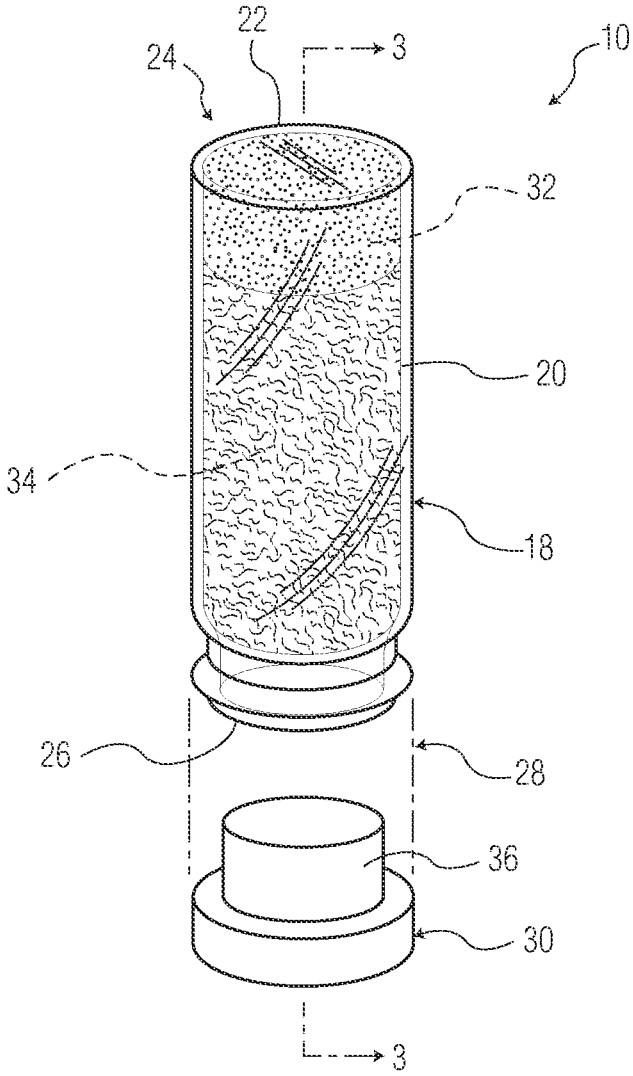
FIG. 2 is a pictorial view of a photoluminescent device for one embodiment of the present invention.
Figure 3:
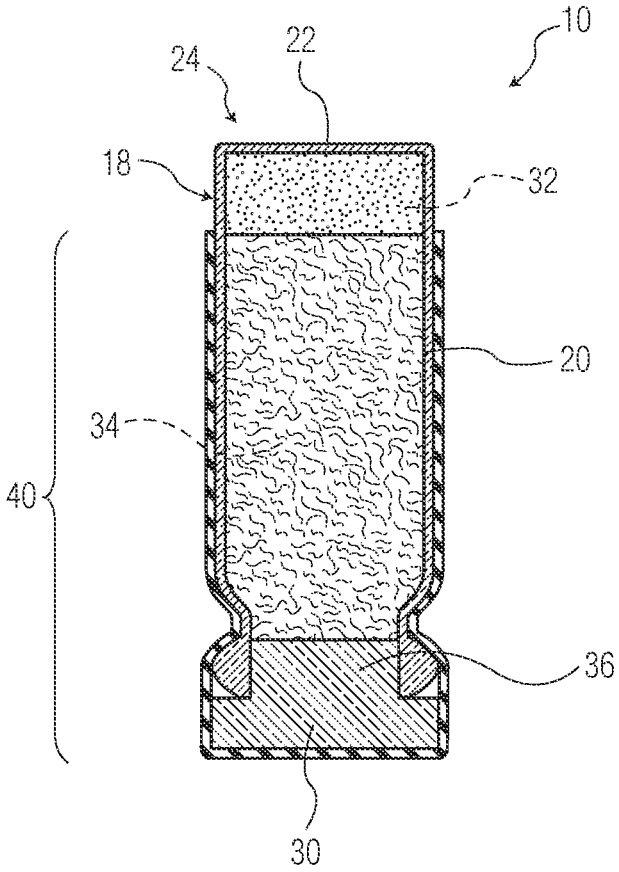
FIG. 3 is a cross sectional view of the photoluminescent device with a coating of a sealant material taken along lines 3-3 of FIG. 2 in accordance with the present invention.

Referring to FIGS. 2 and 3, the device 10 includes an elongate substantially cylindrical transparent vessel or container 18, an interior cavity 20 defined by the container 18, an optically transparent upper surface 22 located at a first end 24 of the container 18, an opening 26 in communication with the interior cavity 20 located at a second end 28 of the container 18, and a cap 30 for insertion into the opening 26 and hermetically sealing the interior cavity 20 from the exterior. The device 10 further includes a photoluminescent material 32 disposed within the interior cavity 20 proximate the optically transparent upper surface 22, and an inert filler 34 occupying the remaining volume of the interior cavity 20 to urge and retain the photoluminescent material 32 against the optically transparent upper surface 22 of the container 18.

The optically transparent upper surface 22 is sufficiently light transmissible to permit the passage of light from a natural or artificial light source to the photoluminescent material 32 contained in the device 10 under charging conditions, and from the photoluminescent material 32 to the exterior under discharging conditions. The upper surface 22 can be convex, dome-shaped, concave or flat. In a preferred embodiment, the upper surface 22 is substantially flat. The container 18 can be fabricated with any size and/or shape desired for secure mounting in a selected substrate. The container 18 is generally constructed from a rigid material preferably an optically transmissive material selected, for example, from glasses, crystals, polymers, ceramics, metals, and combinations thereof. Preferably, the optically transmissive material is glass.

The photoluminescent material 32 is packed together against the optically transparent upper surface 22 by the inert filler 34. This arrangement maximizes the charge efficiency and visual display of the device 10. In a preferred embodiment of the present invention, the photoluminescent material 32 is selected from a phosphorescent material. Examples of such phosphorescent material include alkaline earth metal aluminates, alkaline earth metal silicates, metal sulfides, and combinations thereof. The phosphorescent material can be in the form of a powder, a granule, a gel, a liquid, a solid or combinations thereof. Suitable phosphorescent materials include Product numbers MHG-4A, MHSB-8D and MHB-4A, each available from Lanxi Minhui Photoluminescent Co. Ltd., Bozhou, Zhejiang of China.

The inert filler 34 is generally composed of a lightweight material preferably resilient, which can be in the form of powders, particulates, granules, fibers, pellets, semi-solids, solids or combinations thereof. Suitable examples of the inert filler 34 include sand, silicone caulk, insulation materials, cotton material, and the like. The cap 30 includes a plug or stopper portion 36 which is frictional fitted for the opening 26 of the container 18. Upon insertion, the cap 30 closes the container 18 and seals the contents of the interior cavity 20.

Figure 4:
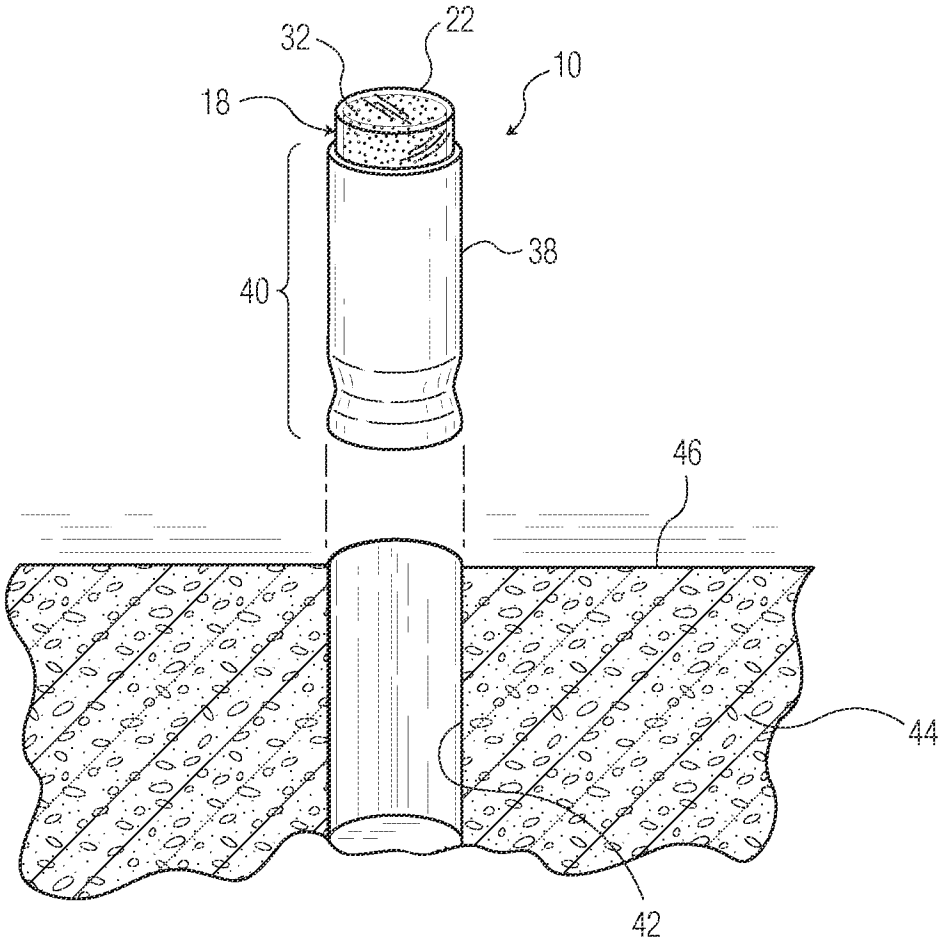
FIG. 4 is a pictorial view of the photoluminescent device coated with the coating prepared for insertion into a hole formed in a substrate in accordance with the present invention.

Referring to FIG. 4, the device 10 can be applied with a coating 38 extending over the surfaces of the cap 30 and a lower portion 40 of the container 18 (see also FIG. 3). The coating 38 is preferably composed of a sealant material to ensure retainment of the cap 30 to the container 18 and maintain a moisture or vapor barrier seal between the contents of the device 10 and the exterior. The sealant material can be selected from plastics, rubbers, metals and combinations thereof. In a preferred embodiment, the sealant material is a rubber. A suitable coating 38 is the PLASTI DIP™ Multipurpose Rubber Coating available from Plasti Dip International, Inc., of Blaine, Minn.

As shown in FIGS. 2-4, the device 10 is assembled by first inserting photoluminescent material 32 into the container 18 via the opening 26. The inert filler 34, preferably cotton, is then tightly packed into the interior cavity 20 of the container 18 via the opening 26. The cap 30 is affixed to the container 18 with the plug portion 36 press fitted into the opening 26, and applying upward pressure against the inert filler 34. The device 10 is dipped into a liquid sealant material to produce a coating 38 extending over the cap 30 and lower portion 40 of the container 18. The coating 38 of sealant material is allowed to dry and seal the device 10.

The device 10 can be charged by natural or artificial light sources through the optically transparent upper surface 22 of the container 18. Under low light or dark conditions, the photoluminescent material 32 discharges the stored energy by re-emitting light to the exterior via the optically transparent upper surface 22 of the container 18. The device 10 is installed by forming a bore or hole 42 into the surface 46 of a substrate 44 (e.g., paver, brick, tile, concrete, wood and natural stone). This can be achieved by any means known to one skilled in the art including drilling. The substrate 44 can be part of a larger structure such as driveway, sidewalk, pool deck, hallway, patio deck, boat dock and the like. The device 10 is positioned with the lower portion 40 of the container 18 inserted through the top of the bore 42 until the optically transparent upper surface 22 is level with the substrate surface 46 for a flush fit.

The forgoing discussion discloses and describes merely exemplary embodiments of the present invention. One skilled in the art will readily recognize from such discussion, and from the accompanying claims, that various changes, modifications, and variations can be made therein without departing from the spirit and scope of the invention as defined in the following claims.

What is claimed is:

1. A photoluminescent device, comprising:

a housing having an optically transmissive upper surface, said housing defining an interior cavity;

a photoluminescent material disposed within the interior cavity proximate said optically transmissive upper surface;

said housing including a body portion configured for insertion into a bore or hole in a substrate with the optically transmissive upper surface positioned proximate to the surface of said substrate;

said housing further including an opening in the body portion located at an opposite end from the optically transmissive upper surface; and a cap adapted for frictional retainment within said opening to seal the interior cavity from the exterior.

2. The photoluminescent device of claim 1, wherein the optically transmissive surface is transparent.

3. The photoluminescent device of claim 1, wherein the body portion is elongate.

4. The photoluminescent device of claim 1, wherein the housing is at least substantially cylindrical.

5. The photoluminescent device of claim 1, further comprising an inert filler disposed within the interior cavity for urging and retaining the photoluminescent material against the optically transmissive upper surface of the housing.

6. The photoluminescent device of claim 5, wherein the inert filler is selected from the group consisting of powders, particulates, granules, fibers, pellets, semi-solids, solids and combinations thereof.

7. The photoluminescent device of claim 1, further comprising a moisture or vapor resistant coating extending over the surface of the cap and the body portion.

8. The photoluminescent device of claim 7, wherein the coating comprises a sealant.

9. The photoluminescent device of claim 8, wherein the sealant is selected from the group consisting of plastics, rubbers, metals and combinations thereof.

10. The photoluminescent device of claim 1, wherein the housing comprises an optically transmissive material.

11. The photoluminescent device of claim 10, wherein the optically transmissive material is selected from the group consisting of glasses, crystals, polymers, ceramics, metals, and combinations thereof.

12. The photoluminescent device of claim 1, wherein the photoluminescent material is a phosphorescent material.

13. The photoluminescent device of claim 12, wherein the phosphorescent material is selected from the group consisting of alkaline earth metal aluminates, alkaline earth metal silicates, metal sulfides, and combinations thereof.

14. The photoluminescent device of claim 1, wherein the photoluminescent material selected from the group consisting of powders, gels, granules, liquids, solids and combinations thereof.

15. A photoluminescent device, comprising:

a substantially cylindrical housing having an optically transparent upper surface, said housing defining an interior cavity;

a phosphorescent material disposed within the interior cavity proximate said optically transparent upper surface; and said housing including an elongate body portion configured for insertion into a bore or hole in a substrate with the optically transparent upper surface positioned proximate to the surface of said substrate;

said housing further including an opening in the body portion located at an opposite end from the optically transmissive upper surface; and a cap adapted for frictional retainment within said opening to seal the interior cavity from the exterior.

16. The photoluminescent device of claim 15, further comprising a moisture or vapor resistant coating extending over the surface of the cap and the body portion.

17. The photoluminescent device of claim 15, further comprising an inert filler disposed within the interior cavity for urging the photoluminescent material against the optically transparent upper surface of the housing.

18. A method for using a photoluminescent device, comprising the steps of:

forming a bore or hole into the surface of a substrate;

obtaining a photoluminescent device comprising:

a housing having an optically transmissive upper surface, said housing defining an interior cavity; a photoluminescent material disposed within the interior cavity proximate said optically transmissive upper surface;

said housing including a body portion configured for insertion into the bore or hole in said substrate with the optically transmissive upper surface positioned proximate to the surface of said substrate;

said housing further including an opening in the body portion located at an opposite end from the optically transmissive upper surface; and a cap adapted for frictional retainment within said opening to seal the interior cavity from the exterior; and inserting the body portion of the photoluminescent device housing into the bore or hole with the optically transmissive upper surface positioned proximate to the surface of said substrate.

* * * * *